US010109923B2

(12) United States Patent
Jan et al.

(10) Patent No.: US 10,109,923 B2
(45) Date of Patent: Oct. 23, 2018

(54) COMPLEX ANTENNA

(71) Applicant: Wistron NeWeb Corporation, Hsinchu (TW)

(72) Inventors: Cheng-Geng Jan, Hsinchu (TW); Chieh-Sheng Hsu, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 230 days.

(21) Appl. No.: 15/215,548

(22) Filed: Jul. 20, 2016

(65) Prior Publication Data

US 2017/0085001 A1 Mar. 23, 2017

(30) Foreign Application Priority Data

Sep. 22, 2015 (TW) ..... 104131202 A

(51) Int. Cl.

| | |
|---|---|
| ***H01Q 15/14*** | (2006.01) |
| ***H01Q 9/06*** | (2006.01) |
| ***H01Q 21/06*** | (2006.01) |
| ***H01Q 1/36*** | (2006.01) |

(52) U.S. Cl.

CPC ..... *H01Q 9/065* (2013.01); *H01Q 1/36* (2013.01); *H01Q 15/14* (2013.01); *H01Q 21/065* (2013.01)

(58) Field of Classification Search

CPC ..... H01Q 9/065; H01Q 15/14; H01Q 21/065; H01Q 1/36

USPC ..... 343/700, 702, 705

See application file for complete search history.

(56) References Cited

U.S. PATENT DOCUMENTS

| | | | | |
|---|---|---|---|---|
| 7,710,334 | B2 * | 5/2010 | Noro | H01Q 1/1214 343/715 |
| 7,764,240 | B2 * | 7/2010 | Hilgers | G06K 19/07749 343/735 |
| 8,674,882 | B2 * | 3/2014 | Huang | H01Q 1/36 343/700 MS |
| 9,941,580 | B2 * | 4/2018 | Hsu | H01Q 1/36 |

FOREIGN PATENT DOCUMENTS

| | | |
|---|---|---|
| TW | 201236265 A1 | 9/2012 |

* cited by examiner

*Primary Examiner* — Brian Young
(74) *Attorney, Agent, or Firm* — Winston Hsu

(57) ABSTRACT

A complex antenna configured to transmit or receive radio-frequency signals includes a first antenna unit and a second antenna unit. The first antenna unit is fixed to the second antenna unit with a first included angle, and the complex antenna does not have a closed annular structure.

10 Claims, 9 Drawing Sheets

COMPLEX ANTENNA

BACKGROUND OF THE INVENTION

1. Field of the Invention

The present invention is related to a complex antenna, and more particularly, to a complex antenna which suits both dimension and cost requirements, ensures high antenna gain value and beam coverage rate, and offers adaptive beam alignment capabilities.

2. Description of the Prior Art

Electronic products with wireless communication functionalities utilize antennas to emit and receive radio waves, to transmit or exchange radio signals, so as to access a wireless communication network. With the advance of wireless communication technology, demand for transmission capacity and wireless network ability has grown dramatically in recent years. A long term evolution (LTE) wireless communication system and a wireless local area network standard IEEE 802.11n both support multi-input multi-output (MIMO) communication technology, which can vastly increase system throughput and transmission distance without increasing system bandwidth or total transmission power expenditure, thereby effectively enhancing spectral efficiency and transmission rate for the wireless communication system, as well as improving communication quality. Consequently, MIMO communication technology plays a critical role in a wireless communication system.

There are many kinds of antennas that support MIMO communication technology. A panel-type antenna has less complex structure and is rather inexpensive. However, the beamwidth of the panel-type antenna in the horizontal plane is narrow, meaning that its beam coverage rate is low, and hence the panel-type antenna can hardly be mounted easily and accurately. Worst of all, the panel-type antenna lacks adaptive beam alignment capabilities. With an antenna motor, direction of the panel-type antenna can be changed to find best reception, thereby solving the major drawback of the panel-type antenna. An antenna motor however costs a lot of money and sets limits on installation conditions, which cannot accommodate the trend for smaller-sized electronic products. FIG. 1 is a schematic diagram illustrating a complex antenna 10. The complex antenna 10 disposed in a cylindrical radome RAD comprises antenna units U1, U2, U3 and U4 of identical structure and size. The antenna units U1 to U4 divide the cylindrical radome RAD up into 4 equal sections each having the same space angle; consequently, a projection of the complex antenna 10 orthogonally projected onto a horizontal plane is symmetrical with respect to 4 symmetrical axes. The complex antenna 10 has high beam coverage rate and receives signals from or transmits signals to all directions without being pointed. The complex antenna 10 requires no antenna motor and cuts the cost, but the complex antenna 10 occupies more space. Compared with the area of a reflective unit of the panel-type antenna, the area of a reflective unit of each antenna unit (for example, the antenna unit U1) in the complex antenna 10 is smaller, such that antenna gain value of each antenna unit of the complex antenna 10 would be lower.

Therefore, it is a common goal in the industry to design antennas that suit both dimension and cost requirements, ensure high antenna gain value and beam coverage rate, and offer adaptive beam alignment capabilities.

SUMMARY OF THE INVENTION

Therefore, the present invention primarily provides a complex antenna, which suits both dimension and cost requirements, ensures high antenna gain value and beam coverage rate, and offers adaptive beam alignment capabilities.

A complex antenna configured to transmit or receive radio-frequency signals comprises a first antenna unit; and a second antenna unit; wherein the first antenna unit is fixed to the second antenna unit with a first included angle, and the complex antenna does not have a closed annular structure.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
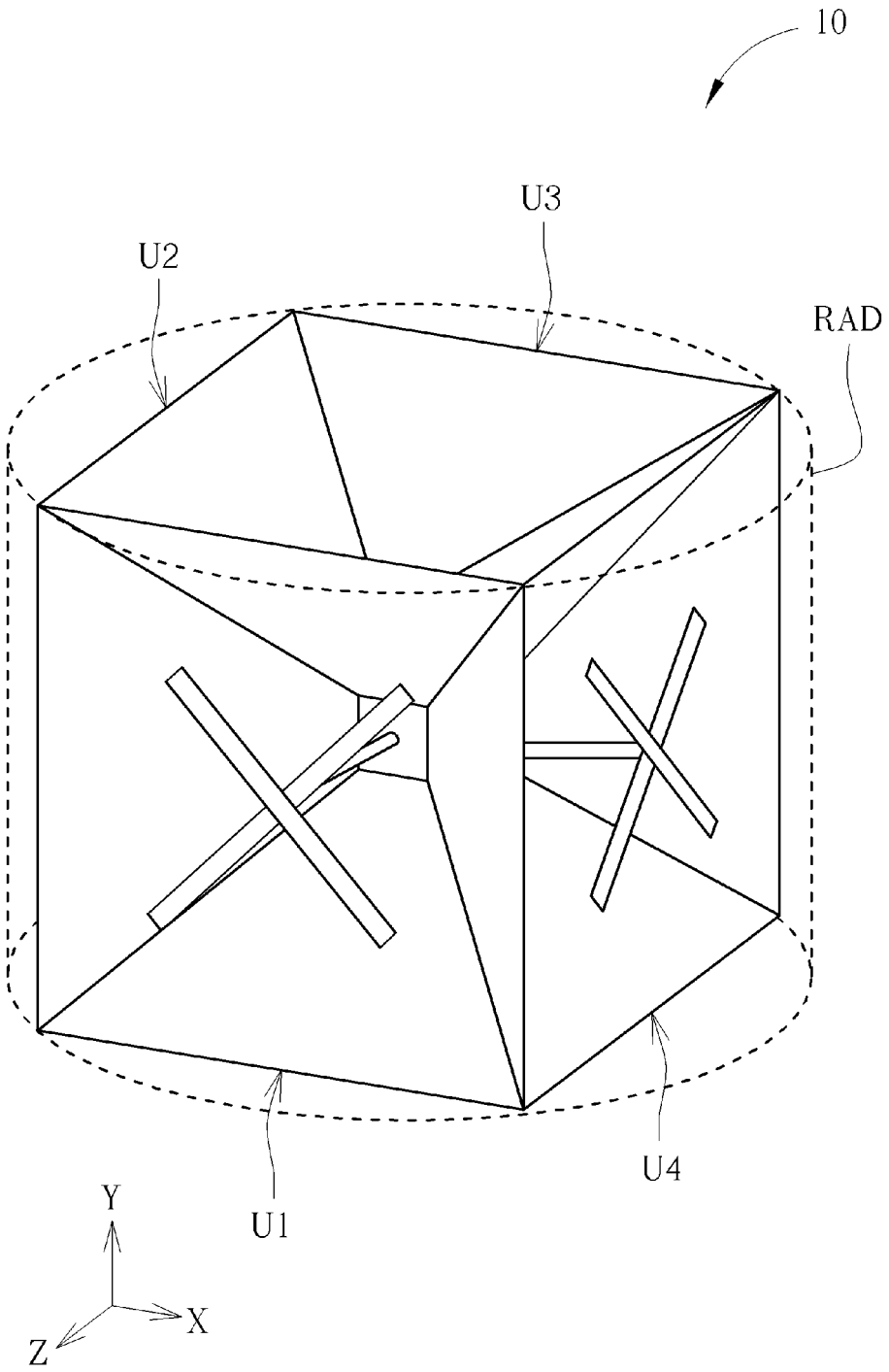
FIG. 1 is a schematic diagram illustrating a complex antenna.
Figure 2A:
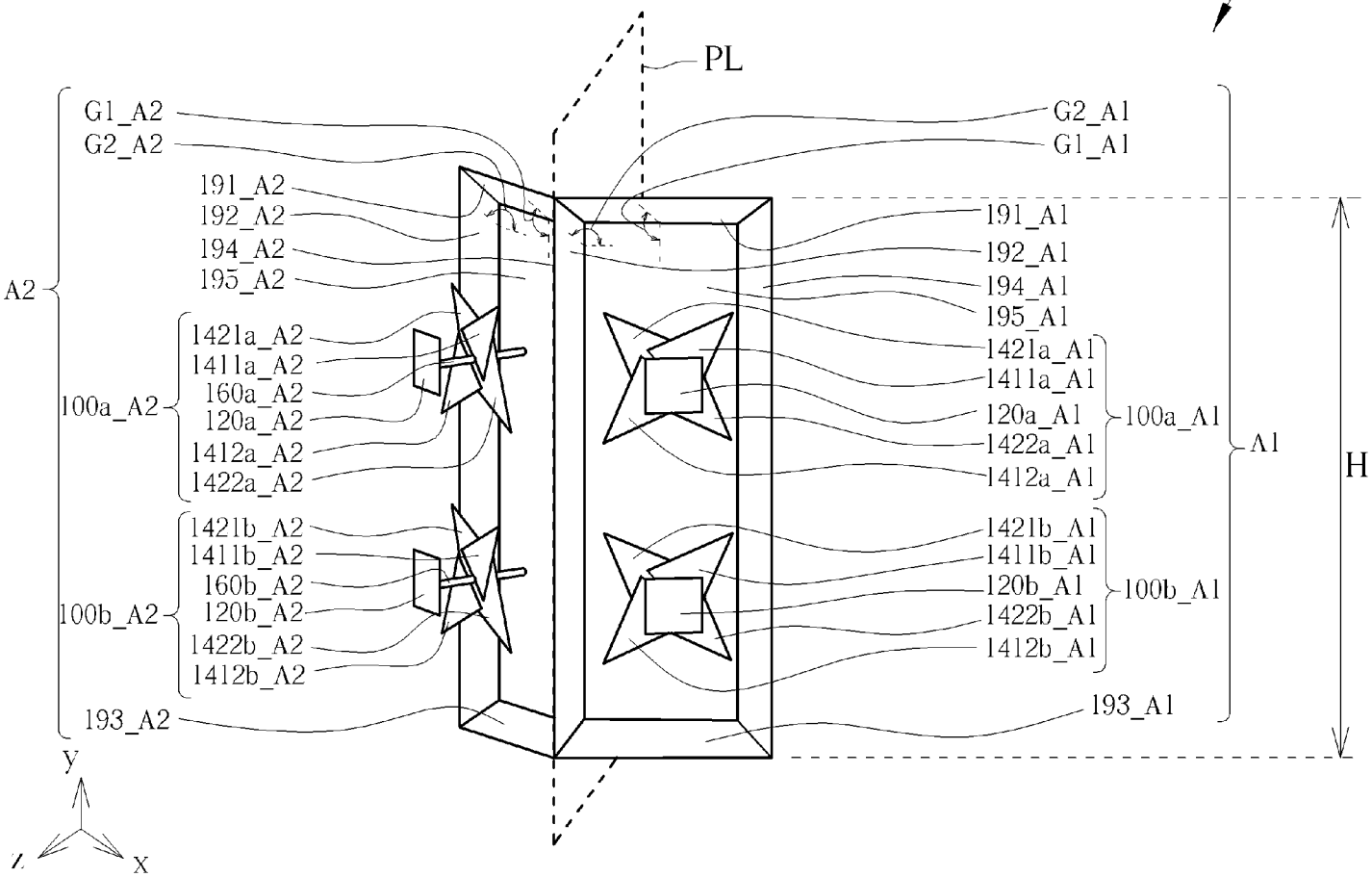
FIG. 2A is a schematic diagram illustrating a complex antenna according to an embodiment of the present invention.
Figure 2B:
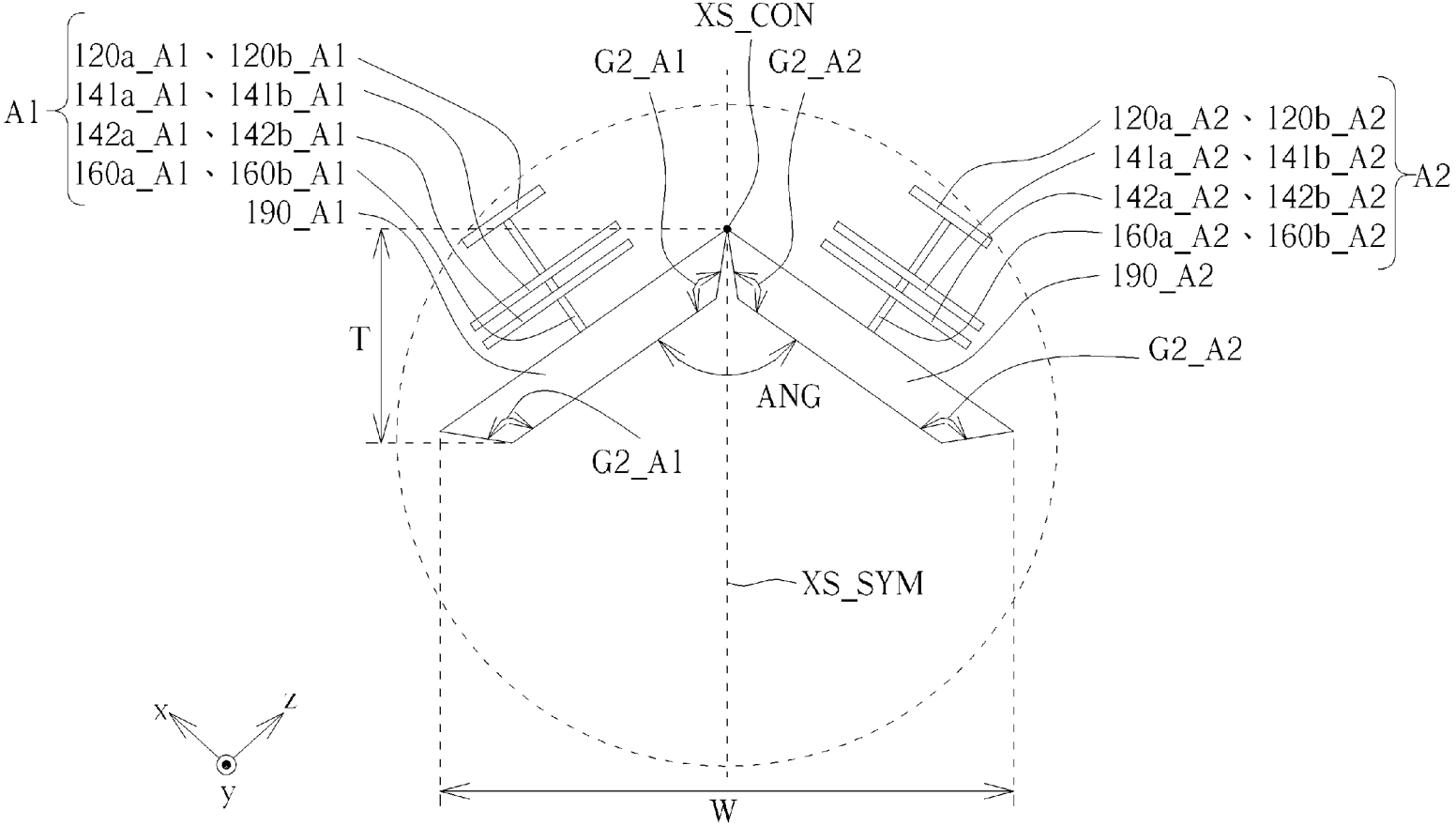
FIG. 2B is a schematic diagram illustrating a top view of the complex antenna shown in FIG. 2A.

Please refer to FIG. 2A and FIG. 2B. FIG. 2A is a schematic diagram illustrating a complex antenna 20 according to an embodiment of the present invention. FIG. 2B is a schematic diagram illustrating a top view of the complex antenna 20. The complex antenna 20 comprises antenna units A1 and A2. The antenna unit A1 comprises antenna elements 100*a*_A1, 100*b*_A1 and a reflective unit 190_A1; the antenna unit A2 comprises antenna elements 100*a*_A2, 100*b*_A2 and a reflective unit 190_A2. The antenna elements 100*a*_A1 and 100*b*_A1 comprise reflective plates 120*a*_A1, 120*b*_A1, radiation units 141*a*_A1, 142*a*_A1, 141*b*_A1, 142*b*_A1 and supporting elements 160*a*_A1, 160*b*_A1 respectively; the antenna elements 100*a*_A2 and 100*b*_A2 comprise reflective plates 120*a*_A2, 120*b*_A2, radiation units 141*a*_A2, 142*a*_A2, 141*b*_A2, 142*b*_A2 and supporting elements 160*a*_A2, 160*b*_A2 respectively. The complex antenna 20 can switch between a first single-beam mode and a second single-beam mode so as to transmit or receive radio-frequency signals by means of the antenna unit A1 or the antenna unit A2. When the complex antenna 20 switches to the first single-beam mode, radio-frequency signals are transmitted or received by the antenna unit A1. When the complex antenna 20 switches to the second single-beam mode, radio-frequency signals are transmitted or received by the antenna unit A2. Alternatively, the complex antenna 20 can switch to a combined-beam mode so as to transmit or receive radio-frequency signals by means of the antenna unit A1 as well as the antenna unit A2. In such a situation, the single beams of the antenna units A1 and A2 are synthesized into the field pattern of the complex antenna 20. As shown in FIG. 2B, the antenna units A1 and A2 are identical and have the same structure and size, such that a projection of the antenna units A1 and A2 orthogonally projected onto a horizontal plane (i.e. xz plane) is symmetrical with respect to a symmetrical axis XS_SYM. Moreover, the antenna units A1 and A2 are connected to each other by means of a hinge axis XS_CON, which functions as hinges. The hinge axis XS_CON allows a limited angle of rotation (such as a first included angle ANG) between the antenna units A1 and A2. The first included angle ANG may be substantially in a range of 70 degrees to 150 degrees, which mainly depends on gain value and beam coverage rate of the complex antenna 20 operated in the combined-beam mode. As the first included angle ANG increases, the gain value becomes higher but the beam coverage rate shrinks. If the first included angle ANG is reduced, the gain value decreases but the beam coverage rate is improved.

Briefly, without multiple antenna units arranged to form an annular structure as the complex antenna 10, the complex antenna 20 does not have a closed annular structure and thus saves cost and space. Besides, there is no need to dispose the complex antenna 20 in a cylindrical radome, so size limitations on the reflective units 190_A1 and 190_A2 are fewer. Even if the complex antenna 20 is disposed in a cylindrical radome, the reflective units 190_A1 and 190_A2 may be arbitrary adjusted to a larger size than usual because the complex antenna 20 comprises merely the antenna units A1 and A2. Therefore, by properly configuring and modifying the reflective unit 190_A1, 190_A2 and the first included angle ANG, the gain value and the beam coverage rate may be effectively improved. By switching the complex antenna 20 between the first single-beam mode, the second single-beam mode and the combined-beam mode, the complex antenna 20 is able to offer adaptive beam alignment capabilities.

Specifically, the reflective units 190_A1 and 190_A2 of the antenna units A1 and A2 utilized to increase gain value comprises peripheral reflective elements 191_A1 to 194_A1, 191_A2 to 194_A2 and central reflective elements 195_A1, 195_A2, respectively. The peripheral reflective elements 191_A1 to 194_A1, 191_A2 to 194_A2 and central reflective elements 195_A1, 195_A2 may be made from metal plates. Each of the central reflective elements 195_A1 and 195_A2 has a shape substantially conforming to a rectangle; each of the peripheral reflective elements 191_A1 to 194_A1 and 191_A2 to 194_A2 has a shape substantially conforming to an isosceles trapezoid with symmetry. Taken together, the peripheral reflective elements 191_A1 to 194_A1 enclose the central reflective elements 195_A1 symmetrically to form a frustum structure, and the peripheral reflective elements 191_A2 to 194_A2 enclose the central reflective elements 195_A2 symmetrically to form a frustum structure.

To achieve symmetry, there is a frustum angle G1_A1, which is substantially in a range of 90 degrees to 180 degrees, from the peripheral reflective element 191_A1 to the central reflective element 195_A1 and from the peripheral reflective element 193_A1 to the central reflective element 195_A1; there is a frustum angle G2_A1, which is substantially in a range of 90 degrees to 180 degrees, from the peripheral reflective element 192_A1 to the central reflective element 195_A1 and from the peripheral reflective element 194_A1 to the central reflective element 195_A1. Likewise, there is a frustum angle G1_A2, which is substantially in a range of 90 degrees to 180 degrees, from the peripheral reflective element 191_A2 to the central reflective element 195_A2 and from the peripheral reflective element 193_A2 to the central reflective element 195_A2; there is a frustum angle G2_A2, which is substantially in a range of 90 degrees to 180 degrees, from the peripheral reflective element 192_A2 to the central reflective element 195_A2 and from the peripheral reflective element 194_A2 to the central reflective element 195_A2. By appropriately adjusting sizes of the central reflective elements 195_A1, 195_A2, heights of the peripheral reflective elements 191_A1 to 194_A2 and the frustum angles G1_A1 to G2_A2, the gain value may increase and the complex antenna 20 may be optimized.

Because the antenna unit A1 comprises the antenna elements 100*a*_A1 and 100*b*_A1 of the same structure and size, the antenna unit A1 forms an array antenna structure with symmetry to enhance maximum gain value on the horizontal plane. Similarly, the antenna elements 100*a*_A2 and 100*b*_A2 of the same structure and size constitute the antenna unit A2 to form an array antenna structure with symmetry, thereby raising maximum gain value on the horizontal plane. The reflective plates 120*a*_A1, 120*b*_A1 and the radiation units 141*a*_A1, 142*a*_A1, 141*b*_A1, 142*b*_A1 of the antenna unit A1 are disposed above the central reflective elements 195_A1 with the supporting elements 160*a*_A1 and 160*b*_A1 respectively, and the reflective plates 120*a*_A1, 120*b*_A1 and the radiation units 141*a*_A1 to 142*b*_A1 are electrically isolated from the reflective unit 190_A1—meaning that the reflective plates 120*a*_A1, 120*b*_A1 and the radiation units 141*a*_A1 to 142*b*_A1 are not electrically connected to or contacting the reflective unit 190_A1. The reflective plate 120*a*_A1 (or the reflective plate 120*b*_A1) is configured to increase effective antenna radiation area and compensates for differences between a distance from the radiation unit 141*a*_A1 (or the radiation unit 141*b*_A1) to the central reflective element 195_A1 and a distance from the radiation unit 142*a*_A1 (or the radiation unit 142*b*_A1) to the central reflective element 195_A1, such that the distance between the radiation unit 141*a*_A1 (or the radiation unit 141*b*_A1) and the central reflective element 195_A1 equals to the distance between the radiation unit 142*a*_A1 (or the radiation unit 142*b*_A1)

and the central reflective element 195_A1. Both a geometrical shape of the reflective plate 120*a*_A1 and a geometrical shape of the reflective plate 120*b*_A1 have symmetry, and each may be a circle or a regular polygon with vertices whose number is a multiple of 4. The radiation unit 141*a*_A1 comprises conductor plates 1411*a*_A1 and 1412*a*_A1 with symmetry to form a diamond dipole antenna structure of 45-degree slant polarized; for symmetry, the radiation unit 142*a*_A1 comprises conductor plates 1421*a*_A1 and 1422*a*_A1 with symmetry to form a diamond dipole antenna structure of 135-degree slant polarized correspondingly. As a result, the reflective plate 120*a*_A1, the radiation units 141*a*_A1, 142*a*_A1 and the supporting element 160*a*_A1 may constitute the antenna element 100*a*_A1, which is dual-polarized to provide two sets of independent antenna transmitting and receiving channels, such that the complex antenna 20 is able to support 2×2 multiple-input multiple-output (MIMO) communication technology. Similarly, conductor plates 1411*b*_A1, 1412*b*_A1 of the radiation unit 141*b*_A1 and conductor plates 1421*b*_A1, 1422*b*_A1 of the radiation unit 142*b*_A1 form a diamond dipole antenna structure of 45-degree slant polarized and a diamond dipole antenna structure of 135-degree slant polarized respectively, such that the reflective plate 120*b*_A1, the radiation units 141*b*_A1, 142*b*_A1 and the supporting element 160*b*_A1 may constitute the antenna element 100*b*_A1, which is dual-polarized.

On the other hand, the reflective plates 120*a*_A2, 120*b*_A2 and the radiation units 141*a*_A2, 142*a*_A2, 141*b*_A2, 142*b*_A2 of the antenna unit A2 are disposed above the central reflective elements 195_A2 with the supporting elements 160*a*_A2 and 160*b*_A2 respectively, and the reflective plates 120*a*_A2, 120*b*_A2 and the radiation units 141*a*_A2 to 142*b*_A2 are electrically isolated from the reflective unit 190_A2—meaning that the reflective plates 120*a*_A2, 120*b*_A2 and the radiation units 141*a*_A2 to 142*b*_A2 are not electrically connected to or contacting the reflective unit 190_A2. The reflective plate 120*a*_A2 (or the reflective plate 120*b*_A2) is configured to increase effective antenna radiation area and compensates for differences between a distance from the radiation unit 141*a*_A2 (or the radiation unit 141*b*_A2) to the central reflective element 195_A2 and a distance from the radiation unit 142*a*_A2 (or the radiation unit 142*b*_A2) to the central reflective element 195_A2, such that the distance between the radiation unit 141*a*_A2 (or the radiation unit 141*b*_A2) and the central reflective element 195_A2 equals to the distance between the radiation unit 142*a*_A2 (or the radiation unit 142*b*_A2) and the central reflective element 195_A2. Both a geometrical shape of the reflective plate 120*a*_A2 and a geometrical shape of the reflective plate 120*b*_A2 have symmetry, and each may be a circle or a regular polygon with vertices whose number is a multiple of 4. Conductor plates 1411*a*_A2, 1412*a*_A2 of the radiation unit 141*a*_A2 and conductor plates 1421*a*_A2, 1422*a*_A2 of the radiation unit 142*a*_A2 form a diamond dipole antenna structure of 45-degree slant polarized and a diamond dipole antenna structure of 135-degree slant polarized respectively, such that the reflective plate 120*a*_A2, the radiation units 141*a*_A2, 142*a*_A2 and the supporting element 160*a*_A2 may constitute the antenna element 100*a*_A2, which is dual-polarized. Similarly, conductor plates 1411*b*_A2, 1412*b*_A2 of the radiation unit 141*b*_A2 and conductor plates 1421*b*_A2, 1422*b*_A2 of the radiation unit 142*b*_A2 form a diamond dipole antenna structure of 45-degree slant polarized and a diamond dipole antenna structure of 135-degree slant polarized respectively, such that the reflective plate 120*b*_A2, the radiation units 141*b*_A2, 142*b*_A2 and the supporting element 160*b*_A2 may constitute the antenna element 100*b*_A2, which is dual-polarized.

Figure 3:
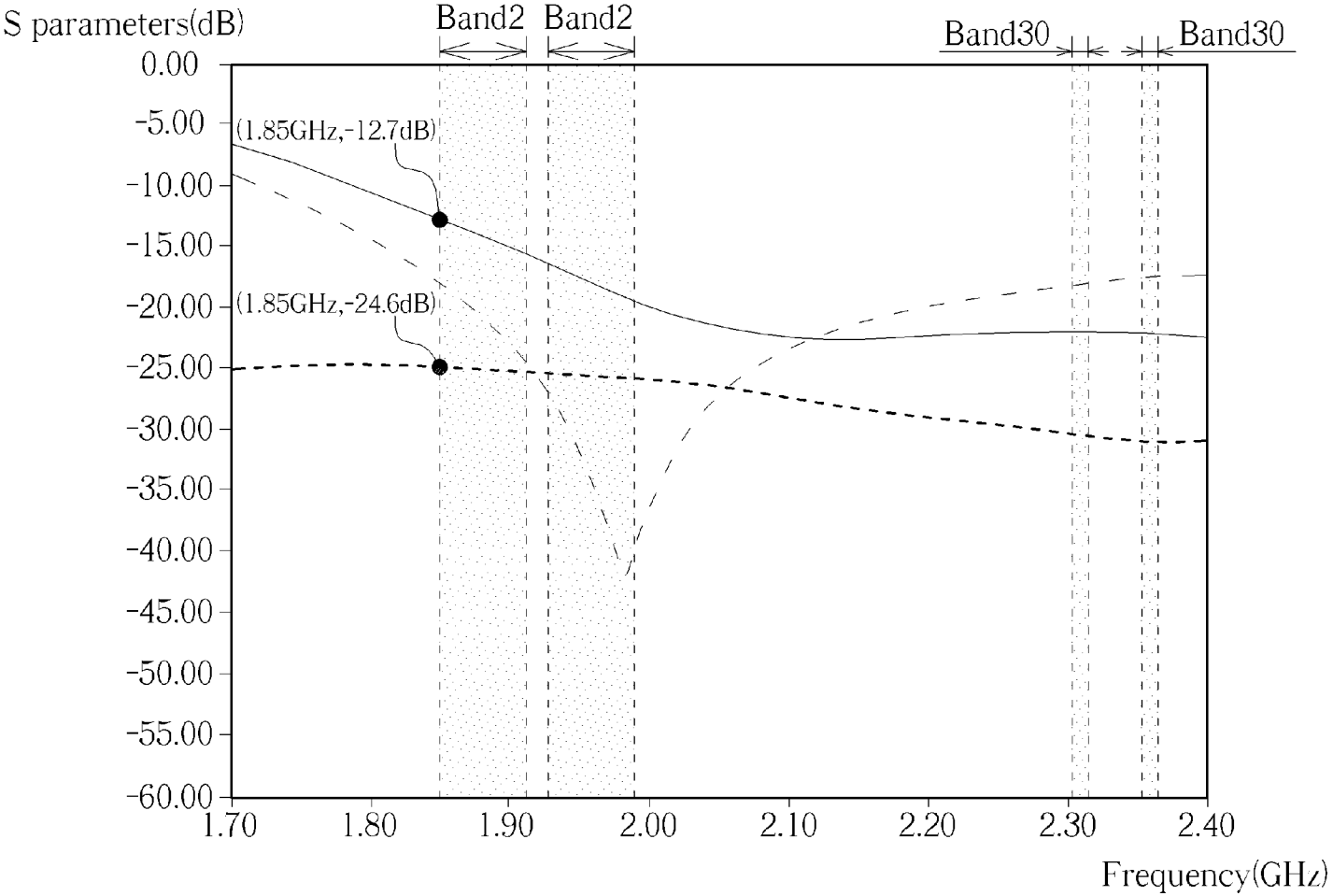
FIG. 3 is a schematic diagram illustrating antenna resonance simulation results of the complex antenna shown in FIG. 2A with the first included angle set to 90 degrees versus different frequencies.

Simulation and measurement may be employed to verify whether the complex antenna 20 operated at Band 2 (1.850 GHz to 1.910 GHz and 1.930 GHz to 1.990 GHz) and Band 30 (2.305 GHz to 2.315 GHz and 2.350 GHz to 2.360 GHz) of LTE wireless communication system meets system requirements. Please refer to FIG. 3 to FIG. 6, Table 1 and Table 2, wherein a height H, a width W, a thickness T and the first included angle ANG of the complex antenna 20 are set to 267 mm, 143.5 mm, 71.8 mm and 90 degrees respectively. In this case, the antenna units A1 and A2 share the peripheral reflective element 192_A1 without disposing the peripheral reflective element 194_A2. FIG. 3 is a schematic diagram illustrating antenna resonance simulation results of the complex antenna 20 with the first included angle ANG set to 90 degrees versus different frequencies. In FIG. 3, antenna resonance simulation results for a 45-degree slant polarized antenna (for example, the diamond dipole antenna structure of 45-degree slant polarized) and a 135-degree slant polarized antenna (for example, the diamond dipole antenna structure of 135-degree slant polarized) are presented by a long dashed line and a solid line respectively; antenna isolation simulation results between the 45-degree slant polarized antenna and the 135-degree slant polarized antenna is presented by a short dashed line. According to FIG. 3, within Band 2 and Band 30, return loss (i.e., S11 value) of the complex antenna 20 is higher than 12.7 dB, and isolation is greater than 24.6 dB, which meet the LTE wireless communication system requirements of having the return loss higher than 10 dB and the isolation greater than 20 dB.

Figure 4:
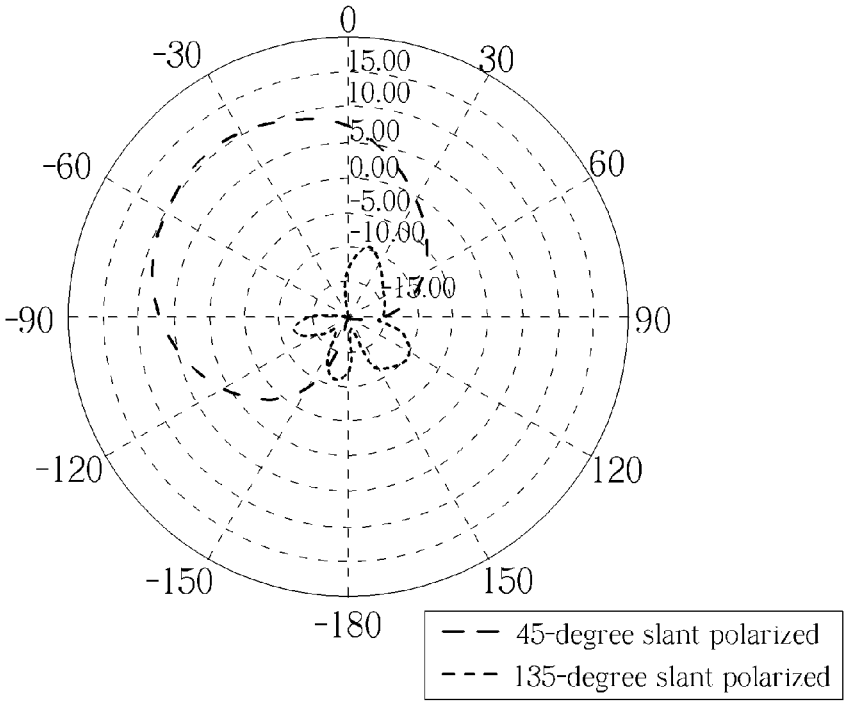
FIG. 4 is a schematic diagram illustrating the radiation pattern of the 45-degree slant polarized antennas of the antenna unit of the complex antenna shown in FIG. 2A with the first included angle set to 90 degrees operated at 1.85 GHz in the horizontal plane in the single-beam mode.
Figure 5:
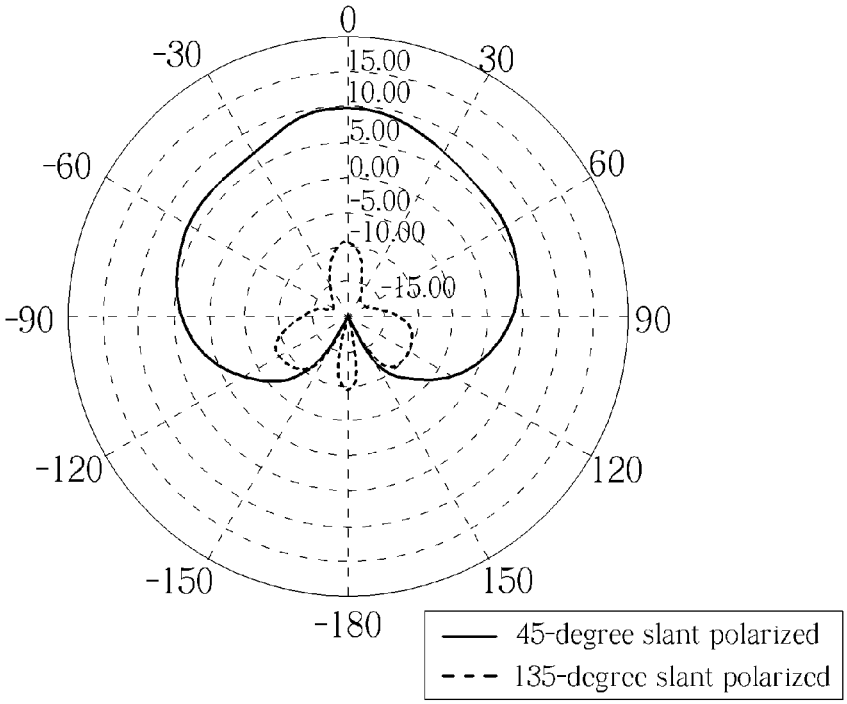
FIG. 5 is a schematic diagram illustrating the radiation pattern of the 45-degree slant polarized antennas of the antenna units of the complex antenna shown in FIG. 2A with the first included angle set to 90 degrees operated at 1.85 GHz in the horizontal plane in the combined-beam mode.
Figure 6:
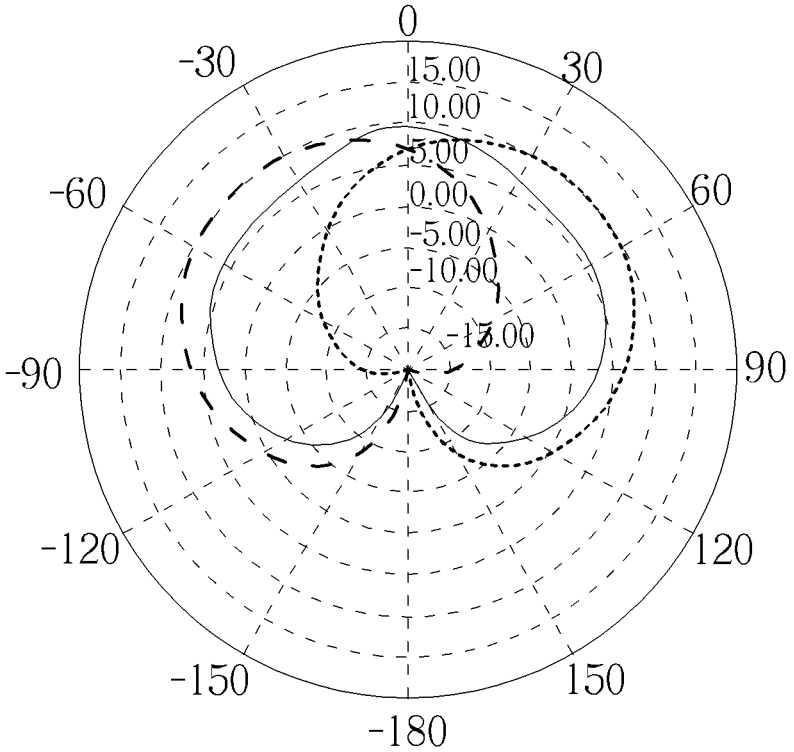
FIG. 6 is a schematic diagram illustrating coverage pattern of 45-degree slant polarized electromagnetic fields of the corresponding 45-degree slant polarized antennas of the complex antenna shown in FIG. 2A with the first included angle set to 90 degrees operated at 1.85 GHz in the horizontal plane in the single-beam mode and the combined-beam mode.

FIG. 4 is a schematic diagram illustrating the radiation pattern of the 45-degree slant polarized antennas of the antenna unit A1 of the complex antenna 20 with the first included angle ANG set to 90 degrees operated at 1.85 GHz in the horizontal plane (i.e., the xz plane) in the single-beam mode. In FIG. 4, the radiation pattern of 45-degree slant polarized electromagnetic fields generated by the 45-degree slant polarized antennas is presented by a long dashed line, while the radiation pattern of 135-degree slant polarized electromagnetic fields generated by the 45-degree slant polarized antennas is presented by a short dashed line. FIG. 5 is a schematic diagram illustrating the radiation pattern of the 45-degree slant polarized antennas of the antenna units A1 and A2 of the complex antenna 20 with the first included angle ANG set to 90 degrees operated at 1.85 GHz in the horizontal plane (i.e., the xz plane) in the combined-beam mode. In FIG. 5, the radiation pattern of 45-degree slant polarized electromagnetic fields generated by the 45-degree slant polarized antennas is presented by a solid line, while the radiation pattern of 135-degree slant polarized electromagnetic fields generated by the 45-degree slant polarized antennas is presented by a short dashed line. FIG. 6 is a schematic diagram illustrating coverage pattern of 45-degree slant polarized electromagnetic fields of the corresponding 45-degree slant polarized antennas of the complex antenna 20 with the first included angle ANG set to 90 degrees operated at 1.85 GHz in the horizontal plane (i.e., the xz plane) in the single-beam mode and the combined-beam mode. In FIG. 6, the radiation pattern of 45-degree slant polarized electromagnetic fields of the antenna units A1 and A2 in the single-beam mode are presented by a long dashed line (corresponding to the long dashed line shown in FIG. 4) and a short dashed line respectively, while the radiation pattern of 45-degree slant polarized electromagnetic fields of the antenna units A1 and A2 in the combined-beam mode is presented by a solid line (corresponding to the solid line shown in FIG. 5). According to FIG. 4 and FIG. 6, the antenna units A1 and A2 of the complex antenna 20 meet the LTE wireless communication system requirements of having maximum gain value (or antenna peak gain) in single-beam mode greater than 8 dBi and front-to-back (F/B) greater than 20 dB. According to FIG. 6, when the complex antenna 20 is operated in the combined-beam mode, the synthesized field pattern formed by the antenna units A1 and A2 may compensate for an attenuation of gain value of each individual single-beam field pattern of the antenna units A1 and A2 around the their intersections (for example, the intersection plane PL) to improve and raise the gain value as a whole. Antenna pattern characteristic simulation results of the 45-degree slant polarized antennas of the complex antenna 20 operated at other frequencies and antenna pattern characteristic simulation results of the 135-degree slant polarized antennas of the complex antenna 20 are basically similar to aforementioned illustrations and hence are not detailed redundantly.

Table 1 and Table 2 are simulation antenna characteristic tables for the 45-degree slant polarized antennas and the 135-degree slant polarized antennas of the complex antenna 20 versus different frequencies. According to Table 1 and Table 2, although the maximum gain value of the antenna units A1 and A2 in the combined-beam mode is 0.9 dB less than the maximum gain value in the single-beam mode, which forms a hollow radiation pattern, the maximum gain values of the antenna units A1 and A2 in the single-beam mode are in a range of 10.8 dBi to 12.5 dBi, and the maximum gain value of the antenna units A1 and A2 in the combined-beam mode is in a range of 9.88 dBi to 10.6 dBi. Moreover, the gain value around the intersections (i.e., the intersections of the antenna units A1 and A2 in the single-beam mode and the antenna units A1 and A2 in the combined-beam mode) is in a range of 9.17 dBi to 10.1 dBi. These results meet the LTE wireless communication system requirements of having the maximum gain value greater than 8 dBi.

TABLE 1

| | frequency (Mhz) | | | | | | | |
|---|---|---|---|---|---|---|---|---|
| | 1850 | 1910 | 1930 | 1990 | 2305 | 2315 | 2350 | 2360 |
| The maximum gain value of the 45-degree slant polarized antennas of the antenna unit A1 in the horizontal plane in the single-beam mode (dBi) | 10.8 | 11 | 11.1 | 11.3 | 12.3 | 12.3 | 12.4 | 12.5 |
| The 3 dB beamwidth of the 45-degree slant polarized antennas of the antenna unit A1 in the horizontal plane in the single-beam mode (degree) | 79 | 78 | 78 | 76 | 71 | 71 | 71 | 70 |
| The maximum gain value of the 45-degree slant polarized antennas of the antenna unit A2 in the horizontal plane in the single-beam mode (dBi) | 10.8 | 11.1 | 11.1 | 11.4 | 12.4 | 12.4 | 12.5 | 12.5 |
| The 3 dB beamwidth of the 45-degree slant polarized antennas of the antenna unit A2 in the horizontal plane in the single-beam mode (degree) | 79 | 78 | 77 | 76 | 70 | 70 | 70 | 70 |
| The maximum gain value of the 45-degree slant polarized antennas of the antenna units A1 and A2 in the horizontal plane in the combined-beam mode (dBi) | 9.88 | 10.1 | 10.1 | 10.3 | 10.6 | 10.6 | 10.6 | 10.6 |

TABLE 1-continued

| | frequency (Mhz) | | | | | | | |
|---|---|---|---|---|---|---|---|---|
| | 1850 | 1910 | 1930 | 1990 | 2305 | 2315 | 2350 | 2360 |
| The 3 dB beamwidth of the 45-degree slant polarized antennas of the antenna units A1 and A2 in the horizontal plane in the combined-beam mode (degree) | 65 | 64 | 64 | 63 | 141 | 142 | 144 | 144 |
| The minimum gain value around the intersections of the antenna units A1 and A2 in the combined-beam mode and the antenna unit A1 in the single-beam mode (dBi) | 9.19 | 9.37 | 9.42 | 9.55 | 10.1 | 10.1 | 10 | 10 |
| The minimum gain value around the intersections of the antenna units A1 and A2 in the combined-beam mode and the antenna unit A2 in the single-beam mode (dBi) | 9.17 | 9.34 | 9.39 | 9.52 | 9.91 | 9.9 | 9.87 | 9.86 |

TABLE 2

| | frequency (Mhz) | | | | | | | |
|---|---|---|---|---|---|---|---|---|
| | 1850 | 1910 | 1930 | 1990 | 2305 | 2315 | 2350 | 2360 |
| The maximum gain value of the 135-degree slant polarized antennas of the antenna unit A1 in the horizontal plane in the single-beam mode (dBi) | 10.8 | 11.1 | 11.2 | 11.4 | 12.4 | 12.5 | 12.6 | 12.6 |
| The 3 dB beamwidth of the 135-degree slant polarized antennas of the antenna unit A1 in the horizontal plane in the single-beam mode (degree) | 78 | 77 | 76 | 75 | 70 | 70 | 69 | 69 |
| The maximum gain value of the 135-degree slant polarized antennas of the antenna unit A2 in the horizontal plane in the single-beam mode (dBi) | 10.8 | 11.1 | 11.2 | 11.4 | 12.5 | 12.5 | 12.6 | 12.6 |
| The 3 dB beamwidth of the 135-degree slant polarized antennas of the antenna unit A2 in the horizontal plane in the | 77 | 76 | 76 | 74 | 69 | 69 | 68 | 68 |

TABLE 2-continued

| | frequency (Mhz) | | | | | | | |
|---|---|---|---|---|---|---|---|---|
| | 1850 | 1910 | 1930 | 1990 | 2305 | 2315 | 2350 | 2360 |
| single-beam mode (degree) | | | | | | | | |
| The maximum gain value of the 135-degree slant polarized antennas of the antenna units A1 and A2 in the horizontal plane in the combined-beam mode (dBi) | 9.75 | 10 | 10.1 | 10.3 | 10.6 | 10.6 | 10.6 | 10.6 |
| The 3 dB beamwidth of the 135-degree slant polarized antennas of the antenna units A1 and A2 in the horizontal plane in the combined-beam mode (degree) | 70 | 70 | 70 | 72 | 143 | 144 | 145 | 146 |
| The minimum gain value around the intersections of the antenna units A1 and A2 in the combined-beam mode and the antenna unit A1 in the single-beam mode (dBi) | 9.15 | 9.38 | 9.44 | 9.6 | 10.1 | 10.1 | 10 | 10 |
| The minimum gain value around the intersections of the antenna units A1 and A2 in the combined-beam mode and the antenna unit A2 in the single-beam mode (dBi) | 9.07 | 9.28 | 9.34 | 9.49 | 9.82 | 9.81 | 9.78 | 9.77 |

Figure 7:
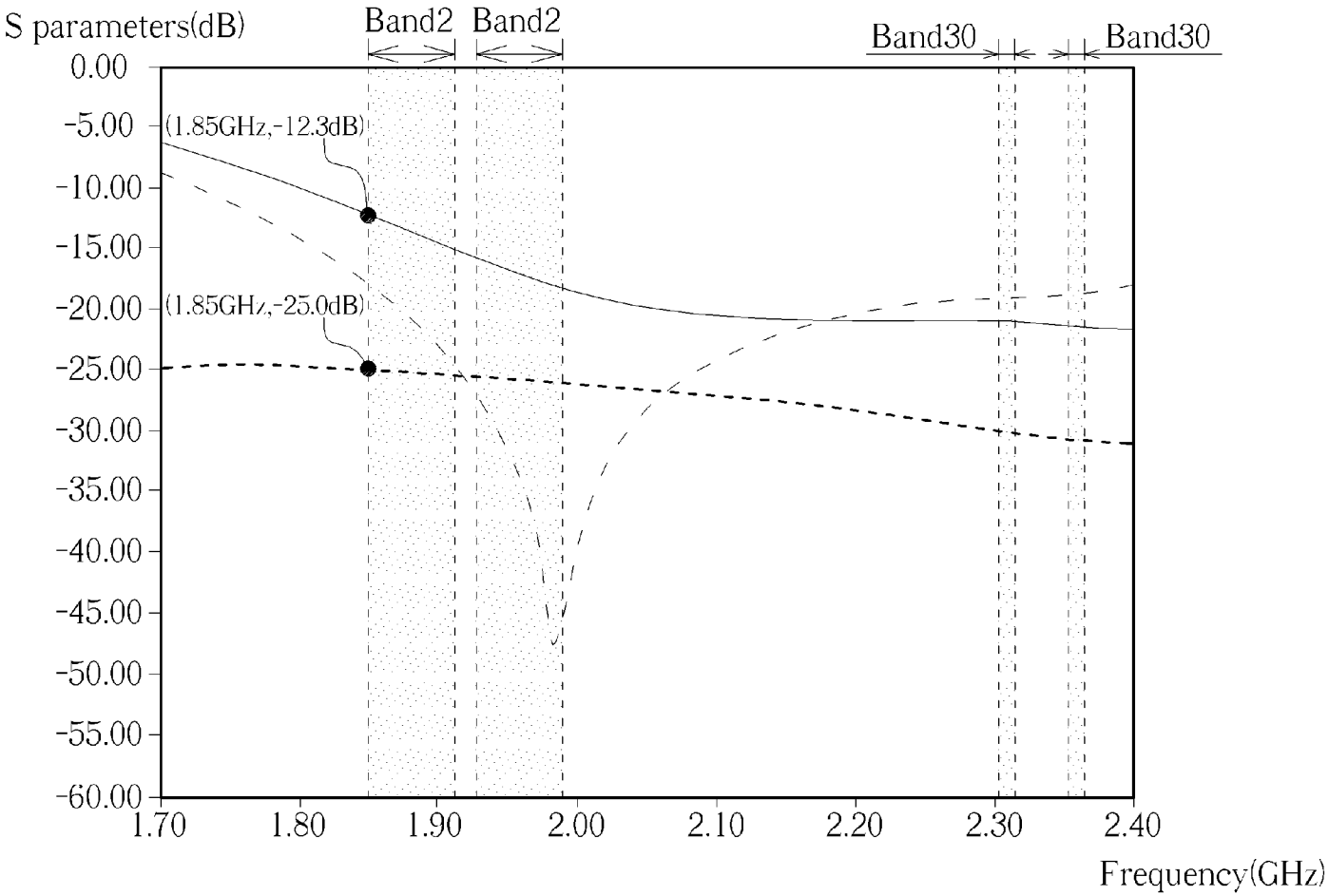
FIG. 7 is a schematic diagram illustrating antenna resonance simulation results of the complex antenna shown in FIG. 2A with the first included angle set to 110 degrees versus different frequencies.

In order to improve the hollow radiation pattern, please refer to FIG. 7 to FIG. 10, Table 3 and Table 4, wherein the height H, the width W, the thickness T and the first included angle ANG of the complex antenna 20 are set to 254 mm, 161 mm, 71.5 mm and 110 degrees respectively. FIG. 7 is a schematic diagram illustrating antenna resonance simulation results of the complex antenna 20 with the first included angle ANG set to 110 degrees versus different frequencies. In FIG. 7, antenna resonance simulation results for a 45-degree slant polarized antenna (for example, the diamond dipole antenna structure of 45-degree slant polarized) and a 135-degree slant polarized antenna (for example, the diamond dipole antenna structure of 135-degree slant polarized) are presented by a long dashed line and a solid line respectively; antenna isolation simulation results between the 45-degree slant polarized antenna and the 135-degree slant polarized antenna is presented by a short dashed line. According to FIG. 7, within Band 2 and Band 30, the return loss (i.e., S11 value) of the complex antenna 20 is higher than 12.3 dB, and the isolation is greater than 25.0 dB, which meet the LTE wireless communication system requirements of having the return loss higher than 10 dB and the isolation greater than 20 dB.

Figure 8:
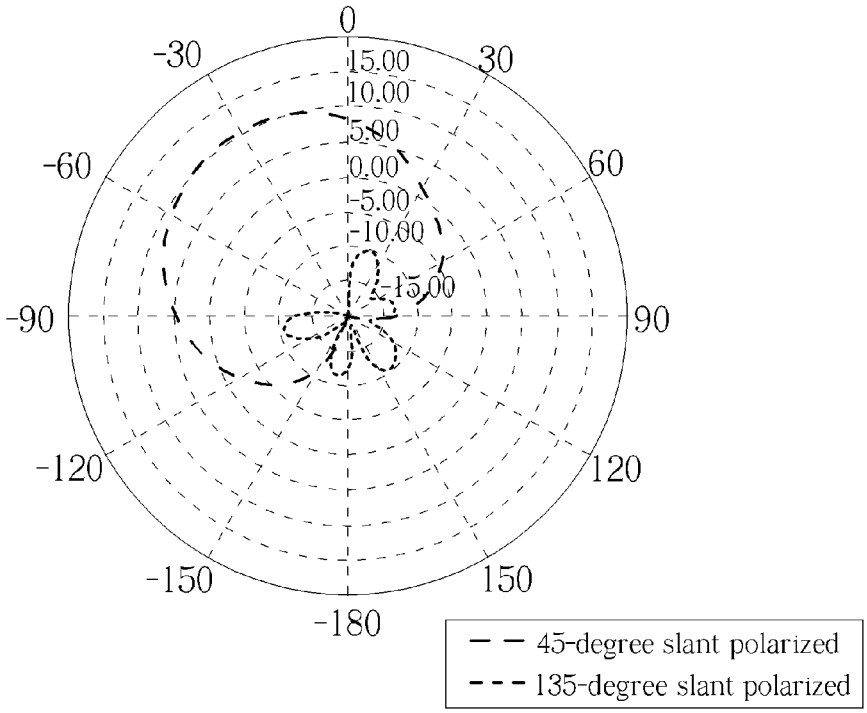
FIG. 8 is a schematic diagram illustrating the radiation pattern of the 45-degree slant polarized antennas of the antenna unit of the complex antenna shown in FIG. 2A with the first included angle set to 110 degrees operated at 1.85 GHz in the horizontal plane in the single-beam mode.
Figure 9:
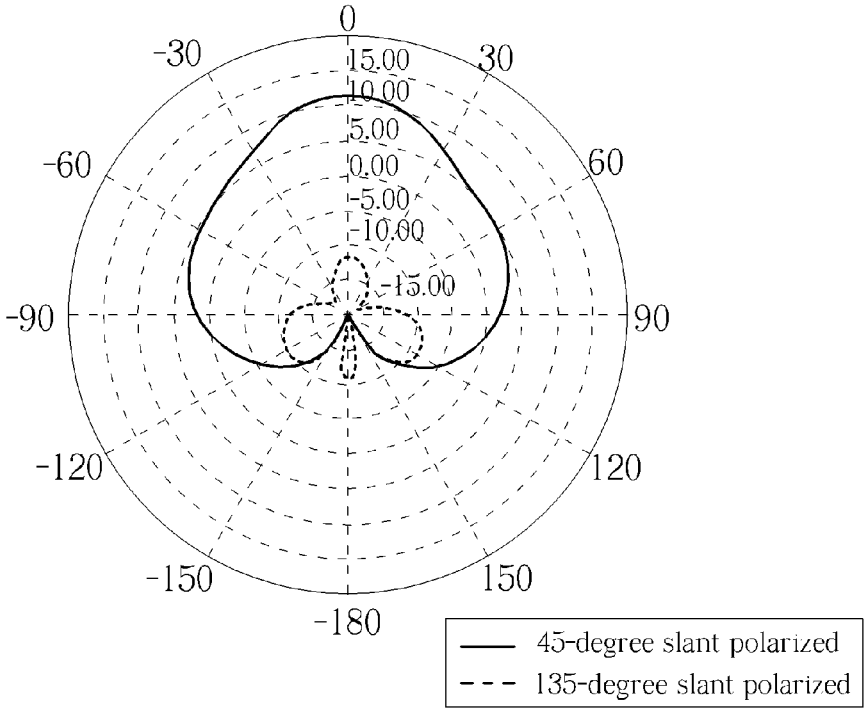
FIG. 9 is a schematic diagram illustrating the radiation pattern of the 45-degree slant polarized antennas of the antenna units of the complex antenna shown in FIG. 2A with the first included angle set to 110 degrees operated at 1.85 GHz in the horizontal plane in the combined-beam mode.
Figure 10:
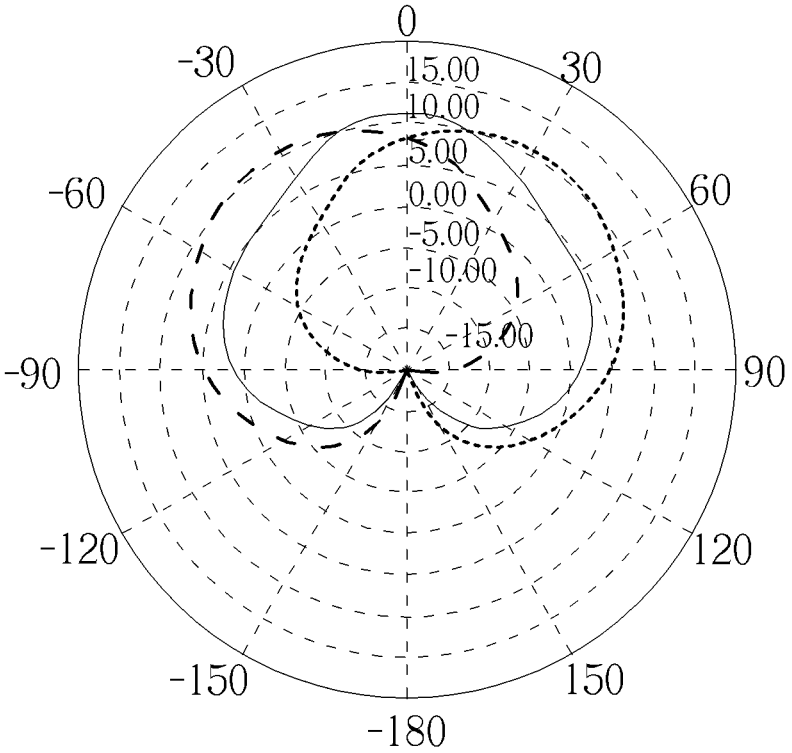
FIG. 10 is a schematic diagram illustrating coverage pattern of 45-degree slant polarized electromagnetic fields of the corresponding 45-degree slant polarized antennas of the complex antenna shown in FIG. 2A with the first included angle set to 110 degrees operated at 1.85 GHz in the horizontal plane in the single-beam mode and the combined-beam mode.

FIG. 8 is a schematic diagram illustrating the radiation pattern of the 45-degree slant polarized antennas of the antenna unit A1 of the complex antenna 20 with the first included angle ANG set to 110 degrees operated at 1.85 GHz in the horizontal plane (i.e., the xz plane) in the single-beam mode. In FIG. 8, the radiation pattern of 45-degree slant polarized electromagnetic fields generated by the 45-degree slant polarized antennas is presented by a long dashed line, while the radiation pattern of 135-degree slant polarized electromagnetic fields generated by the 45-degree slant polarized antennas is presented by a short dashed line. FIG. 9 is a schematic diagram illustrating the radiation pattern of the 45-degree slant polarized antennas of the antenna units A1 and A2 of the complex antenna 20 with the first included angle ANG set to 110 degrees operated at 1.85 GHz in the horizontal plane (i.e., the xz plane) in the combined-beam mode. In FIG. 9, the radiation pattern of 45-degree slant polarized electromagnetic fields generated by the 45-degree slant polarized antennas is presented by a solid line, while the radiation pattern of 135-degree slant polarized electromagnetic fields generated by the 45-degree slant polarized antennas is presented by a short dashed line. FIG. 10 is a schematic diagram illustrating the coverage pattern of 45-degree slant polarized electromagnetic fields of the corresponding 45-degree slant polarized antennas of the complex antenna 20 with the first included angle ANG set to 110 degrees operated at 1.85 GHz in the horizontal plane (i.e., the xz plane) in the single-beam mode and the combined-beam mode. In FIG. 10, the radiation pattern of 45-degree slant polarized electromagnetic fields of the antenna units A1 and A2 in the single-beam mode are presented by a long dashed line (corresponding to the long dashed line shown in FIG. 8) and a short dashed line respectively, while the radiation pattern of 45-degree slant polarized electromagnetic fields of the antenna units A1 and A2 in the combined-beam mode is presented by a solid line (corresponding to the solid line shown in FIG. 9). According to FIG. 8 and FIG. 10, the antenna units A1 and A2 of the complex antenna 20 meet the LTE wireless communication system requirements of having the maximum gain value in single-beam mode greater than 8 dBi and the front-to-back greater than 20 dB. According to FIG. 10, when the complex antenna 20 is operated in the combined-beam mode, the synthesized field pattern formed by the antenna units A1 and A2 may compensate for an attenuation of gain value of each individual single-beam field pattern of the antenna units A1 and A2 around the their intersections (for example, the intersection plane PL) to improve and raise the gain value as a whole. Antenna pattern characteristic simulation results of the 45-degree slant polarized antennas of the complex antenna 20 operated at other frequencies and antenna pattern characteristic simulation results of the 135-degree slant polarized antennas of the complex antenna 20 are basically similar to aforementioned illustrations and hence are not detailed redundantly.

Table 3 and Table 4 are simulation antenna characteristic tables for the 45-degree slant polarized antennas and the 135-degree slant polarized antennas of the complex antenna 20 versus different frequencies. According to Table 3 and Table 4, the maximum gain values of the antenna units A1 and A2 in the single-beam mode are in a range of 10.8 dBi to 12.7 dBi, and the maximum gain value of the antenna units A1 and A2 in the combined-beam mode is in a range of 11.1 dBi to 12.3 dBi. Moreover, the gain value around intersections (i.e., the intersections of the antenna units A1 and A2 in the single-beam mode and the antenna units A1 and A2 in the combined-beam mode) is in a range of 10.1 dBi to 11.6 dBi. These results meet the LTE wireless communication system requirements of having the maximum gain value greater than 8 dBi. The maximum gain value of the antenna units A1 and A2 in the combined-beam mode is similar to the maximum gain value in the single-beam mode, which makes the radiation pattern formed in the combined-beam mode and in the single-beam mode more even. Because the 3 dB beamwidth of the antenna units A1 and A2 in the combined-beam mode is in a range of 65 degrees to 74 degrees, and because the single-beam angles of the antenna units A1 and A2 are 70 degrees respectively, the beam coverage rate of the complex antenna 20 is substantially in a range of 135 to 144 degrees, which meets the LTE wireless communication system requirements.

TABLE 3

| | frequency (Mhz) | | | | | | | |
|---|---|---|---|---|---|---|---|---|
| | 1850 | 1910 | 1930 | 1990 | 2305 | 2315 | 2350 | 2360 |
| The maximum gain value of the 45-degree slant polarized antennas of the antenna unit A1 in the horizontal plane in the single-beam mode (dBi) | 10.8 | 11.1 | 11.1 | 11.3 | 12.5 | 12.5 | 12.6 | 12.6 |
| The 3 dB beamwidth of the 45-degree slant polarized antennas of the antenna unit A1 in the horizontal plane in the single-beam mode (degree) | 74 | 74 | 74 | 73 | 65 | 65 | 65 | 65 |
| The F/B ratio of the 45-degree slant polarized antennas of the antenna unit A1 in the horizontal plane in the single-beam mode (dB) | 22.1 | 23.5 | 23.7 | 25.2 | 25.7 | 24.6 | 24.4 | 23.4 |
| The 3 dB beamwidth of the 45-degree slant polarized antennas of the antenna unit A1 in the vertical plane in the single-beam mode (degree) | 39 | 38 | 38 | 37 | 31 | 31 | 31 | 31 |
| The maximum gain value of the 45-degree slant polarized antennas of the antenna unit A2 in the horizontal plane in the single-beam mode (dBi) | 10.9 | 11.1 | 11.2 | 11.4 | 12.5 | 12.6 | 12.6 | 12.7 |

TABLE 3-continued

| | frequency (Mhz) | | | | | | | |
|---|---|---|---|---|---|---|---|---|
| | 1850 | 1910 | 1930 | 1990 | 2305 | 2315 | 2350 | 2360 |
| The 3 dB beamwidth of the 45-degree slant polarized antennas of the antenna unit A2 in the horizontal plane in the single-beam mode (degree) | 74 | 74 | 74 | 74 | 66 | 66 | 66 | 66 |
| The F/B ratio of the 45-degree slant polarized antennas of the antenna unit A2 in the horizontal plane in the single-beam mode (dB) | 21.4 | 22.8 | 23.3 | 24.9 | 26.3 | 25.8 | 24.5 | 23.9 |
| The 3 dB beamwidth of the 45-degree slant polarized antennas of the antenna unit A2 in the vertical plane in the single-beam mode (degree) | 39 | 38 | 37 | 36 | 31 | 31 | 31 | 31 |
| The maximum gain value of the 45-degree slant polarized antennas of the antenna units A1 and A2 in the horizontal plane in the combined-beam mode (dBi) | 11.1 | 11.4 | 11.5 | 11.7 | 12.3 | 12.3 | 12.3 | 12.3 |
| The 3 dB beamwidth of the 45-degree slant polarized antennas of the antenna units A1 and A2 in the horizontal plane in the combined-beam mode (degree) | 52 | 50 | 50 | 49 | 45 | 45 | 45 | 45 |
| The F/B ratio of the 45-degree slant polarized antennas of the antenna units A1 and A2 in the horizontal plane in the combined-beam mode (dB) | 22.4 | 22.8 | 23 | 23.4 | 28.1 | 28.2 | 28.5 | 28.6 |
| The 3 dB beamwidth of the 45-degree slant polarized antennas of the antenna units A1 and A2 in the vertical plane in the combined-beam mode (degree) | 40 | 39 | 39 | 38 | 33 | 33 | 32 | 32 |
| The minimum gain value around the intersections of the antenna units A1 and A2 in the combined-beam mode and the antenna unit A1 in the single-beam mode (dBi) | 10.1 | 10.3 | 10.4 | 10.6 | 11.2 | 11.3 | 11.4 | 11.4 |
| The minimum gain value around the intersections of the antenna units A1 and A2 in the combined-beam mode and the antenna unit A2 in the single-beam mode (dBi) | 10.1 | 10.4 | 10.5 | 10.7 | 11.5 | 11.6 | 11.6 | 11.6 |

TABLE 4

| | frequency (Mhz) | | | | | | | |
|---|---|---|---|---|---|---|---|---|
| | 1850 | 1910 | 1930 | 1990 | 2305 | 2315 | 2350 | 2360 |
| The maximum gain value of the 135-degree slant polarized antennas of the antenna unit A1 in the horizontal plane in the single-beam mode (dBi) | 10.8 | 11.1 | 11.1 | 11.3 | 12.5 | 12.5 | 12.6 | 12.6 |
| The 3 dB beamwidth of the 135-degree slant polarized antennas of the antenna unit A1 in the horizontal plane in the single-beam mode (degree) | 74 | 74 | 74 | 73 | 65 | 65 | 65 | 65 |
| The F/B ratio of the 135-degree slant polarized antennas of the antenna unit A1 in the horizontal plane in the single-beam mode (dB) | 22.1 | 23.5 | 23.7 | 25.2 | 25.7 | 24.6 | 24.4 | 23.4 |
| The 3 dB beamwidth of the 135-degree slant polarized antennas of the antenna unit A1 in the vertical plane in the single-beam mode (degree) | 39 | 38 | 38 | 37 | 31 | 31 | 31 | 31 |
| The maximum gain value of the 135-degree slant polarized antennas of the antenna unit A2 in the horizontal plane in the single-beam mode (dBi) | 10.9 | 11.1 | 11.2 | 11.4 | 12.5 | 12.6 | 12.6 | 12.7 |
| The 3 dB beamwidth of the 135-degree slant polarized antennas of the antenna unit A2 in the horizontal plane in the single-beam mode (degree) | 74 | 74 | 74 | 74 | 66 | 66 | 66 | 66 |
| The F/B ratio of the 135-degree slant polarized antennas of the antenna unit A2 in the horizontal plane in the single-beam mode (dB) | 21.4 | 22.8 | 23.3 | 24.9 | 26.3 | 25.8 | 24.5 | 23.9 |
| The 3 dB beamwidth of the 135-degree slant polarized antennas of the antenna unit A2 in the vertical plane in the single-beam mode (degree) | 39 | 38 | 37 | 36 | 31 | 31 | 31 | 31 |
| The maximum gain value of the 135-degree slant polarized antennas of the antenna units A1 and A2 in the horizontal plane in the combined-beam mode (dBi) | 11.1 | 11.4 | 11.5 | 11.7 | 12.3 | 12.3 | 12.3 | 12.3 |

TABLE 4-continued

| | frequency (Mhz) | | | | | | | |
|---|---|---|---|---|---|---|---|---|
| | 1850 | 1910 | 1930 | 1990 | 2305 | 2315 | 2350 | 2360 |
| The 3 dB beamwidth of the 135-degree slant polarized antennas of the antenna units A1 and A2 in the horizontal plane in the combined-beam mode (degree) | 52 | 50 | 50 | 49 | 45 | 45 | 45 | 45 |
| The F/B ratio of the 135-degree slant polarized antennas of the antenna units A1 and A2 in the horizontal plane in the combined-beam mode (dB) | 22.4 | 22.8 | 23 | 23.4 | 28.1 | 28.2 | 28.5 | 28.6 |
| The 3 dB beamwidth of the 135-degree slant polarized antennas of the antenna units A1 and A2 in the vertical plane in the combined-beam mode (degree) | 40 | 39 | 39 | 38 | 33 | 33 | 32 | 32 |
| The minimum gain value around the intersections of the antenna units A1 and A2 in the combined-beam mode and the antenna unit A1 in the single-beam mode (dBi) | 10.1 | 10.3 | 10.4 | 10.6 | 11.2 | 11.3 | 11.4 | 11.4 |
| The minimum gain value around the intersections of the antenna units A1 and A2 in the combined-beam mode and the antenna unit A2 in the single-beam mode (dBi) | 10.2 | 10.4 | 10.5 | 10.7 | 11.5 | 11.6 | 11.6 | 11.6 |

The complex antenna 20 is an exemplary embodiment of the invention, and those skilled in the art may make alternations and modifications accordingly. For example, the hinge axis XS_CON connects the antenna units A1 and A2 of the complex antenna 20. However, if the distance between the antenna units A1 and A2 is less than 1 mm, the antenna units A1 and A2 may not be electrically connected. Alternatively, when the first included angle ANG is 90 degrees, the antenna units A1 and A2 share the peripheral reflective element 192_A1 and thus are electrically connected. The antenna units A1 and A2 may be locked in place at the first included angle ANG; however, a dedicated mechanical design may allow the first included angle ANG between the antenna units A1 and A2 to vary within a range of tolerance to facilitate flexibility in signal transmission and reception and to improve utility. According to frequencies and bandwidths of the complex antenna 20, the reflective plate (for example, the reflective plate 120*a*_A1) of an antenna unit (for example, the antenna unit A1) may be removed from one antenna element. Besides, heights of the peripheral reflective elements (for example, the peripheral reflective elements 191_A1 to 194_A1) of the reflective unit (for example, the reflective unit 190_A1) may be reduced to zero so as to simplify the structure of the antenna unit. The conductor plates (for example, the conductor plates 1411*a*_A1 and 1412*a*_A1) of the radiation unit (for example, the radiation unit 141*a*_A1) of an antenna unit (for example, the antenna unit A1) may have other antenna structures except the diamond dipole antenna structure. The two radiation units (for example, the radiation units 141*a*_A1 and 142*a*_A1) may correspond to a 45-degree slant polarized antenna and a 135-degree slant polarized antenna respectively, but not limited thereto. The two radiation units may correspond to two antennas the polarizations of which are orthogonal—for example, the two radiation units may be vertically polarized and horizontally polarized respectively. According to requirements for gain value, each antenna unit (for example, the antenna unit A1) may have an array antenna structure and comprises two antenna elements (i.e., the antenna elements 100*a*_A1 and 100*b*_A1); nevertheless, the present invention is not limited herein, and each antenna unit may comprise more than two antenna elements. Alternatively, it does not require one antenna unit to have an array antenna structure. In certain system specification, the complex antenna 20 may not be operated in the combined-beam mode. In addition, the complex antenna 20 may comprise more than two antenna units to increase the beam coverage rate further.

To sum up, without multiple antenna units arranged to form an annular structure, the complex antenna of the present invention saves cost and space. Since size limitations on the reflective units of the complex antenna are fewer, the gain value and the beam coverage rate may be effectively improved by properly configuring and modifying the reflective units and the first included angle between the antenna units. By switching the complex antenna between the first single-beam mode, the second single-beam mode and the combined-beam mode, the complex antenna of the present invention is able to offer adaptive beam alignment capabilities.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A complex antenna, configured to transmit or receive radio-frequency signals, comprising:

a first antenna unit; and a second antenna unit;

wherein the first antenna unit is fixed to the second antenna unit with a first included angle, and the complex antenna does not have a closed annular structure;

wherein the first included angle is related to a gain value and a beam coverage rate of the complex antenna operated in a combined-beam mode.

2. The complex antenna of claim 1, wherein the first included angle is in a range of 70 degrees to 150 degrees.

3. The complex antenna of claim 1, wherein the first antenna unit and the second antenna unit have identical structures and sizes.

4. The complex antenna of claim 1, wherein each of the first antenna unit and the second antenna unit comprises:

a reflective unit, comprising:

a central reflective element; and a plurality of peripheral reflective elements enclosing the central reflective element to form a frustum structure;

at least one antenna element, each of the at least one antenna element comprising:

at least one radiation unit disposed above the central reflective element; and a reflective plate disposed above the at least one radiation unit, wherein a geometrical shape of the reflective plate has symmetry.

5. The complex antenna of claim 4, wherein the first included angle exists between the central reflective element of the first antenna unit and the central reflective element of the second antenna unit.

6. The complex antenna of claim 4, wherein there is a frustum angle between each peripheral reflective element of the plurality of peripheral reflective elements and the central reflective element, and the frustum angle is in a range of 90 degrees to 180 degrees.

7. The complex antenna of claim 4, wherein a geometrical shape of the reflective plate is a circle or a regular polygon, and a number of vertices of the regular polygon is a multiple of 4.

8. The complex antenna of claim 4, wherein a first conductor plate and a second conductor plate of the at least one radiation unit form a diamond dipole antenna structure.

9. The complex antenna of claim 1, wherein each of the first antenna unit and the second antenna unit has an array antenna structure.

10. The complex antenna of claim 4, wherein the central reflective element of the first antenna unit and the central reflective element of the second antenna unit are perpendicular to a first plane, and a projection of the complex antenna onto the first plane is symmetrical with respect to a symmetrical axis.

* * * * *